United States Patent [19]

Smythe

[11] Patent Number: 4,529,616

[45] Date of Patent: Jul. 16, 1985

[54] METHOD OF FORMING CORROSION RESISTANT COATING

[75] Inventor: John W. Smythe, Birmingham, Mich.

[73] Assignee: Alloy Metals, Inc., Troy, Mich.

[21] Appl. No.: 575,233

[22] Filed: Jan. 30, 1984

Related U.S. Application Data

[62] Division of Ser. No. 411,197, Aug. 25, 1982, Pat. No. 4,453,976.

[51] Int. Cl.[3] ..... B05D 1/08

[52] U.S. Cl. ..... 427/34; 427/423

[58] Field of Search ..... 427/34, 423; 75/251; 420/457

[56] References Cited

U.S. PATENT DOCUMENTS

| | | | |
|---|---|---|---|
| 2,875,043 | 2/1959 | Tour | 420/457 |
| 2,936,229 | 5/1960 | Shepard | 75/254 |
| 3,378,392 | 4/1968 | Longo | 420/457 |
| 3,809,545 | 5/1974 | Benjamin | 75/251 |
| 3,916,497 | 11/1975 | Doi et al. | 420/457 |
| 4,194,900 | 5/1980 | Ide et al. | 75/251 |
| 4,325,994 | 4/1982 | Kitashima et al. | 427/34 |
| 4,361,604 | 11/1982 | Kushner et al. | 75/251 |

*Primary Examiner*—John H. Newsome

*Attorney, Agent, or Firm*—Cullen, Sloman, Cantor, Grauer, Scott & Rutherford

[57] ABSTRACT

An improved thermal spray nickel base alloy powder which forms an extremely tenacious, dense corrosion resistant coating on metal parts subject to a corrosive environment. The disclosed thermal spray powder is a nickel base alloy having 20 to 40% by weight molybdenum, and 12 to 20% by weight chromium, and preferably includes 0 to 10% by weight iron and 0.03 to 2% by weight copper plus vanadium. The metal alloy powder is preferably formed by atomizing the molten alloy, and the coating is preferably formed by thermal or plasma spray.

4 Claims, No Drawings

METHOD OF FORMING CORROSION RESISTANT COATING

This application is a divisional application of my U.S. patent application, Ser. No. 411,197, filed Aug. 25, 1982 now U.S. Pat. No. 4,453,976.

FIELD OF THE INVENTION

A nickel base thermal spray alloy powder including high concentrations of molybdenum and chromium which forms an improved corrosion resistant, dense tenacious coating on metal parts.

DESCRIPTION OF THE PRIOR ART

Corrosion resistant parts, such as boiler or heat exchanger tubes, are generally wought from a corrosion resistant alloy, such as "Hastelloy C" and similar alloys. The alloy must therefore be sufficiently malleable to be thermomechanically worked. Certain of the commercial corrosion resistant alloys have been applied as a coating to metal parts, however, the coating is not sufficiently dense or tenacious to withstand highly corrosive environments, such as boiling sulfuric or hydrochloric acid solutions.

"Hastelloy C", for example, is a commercial corrosion resistant alloy available from Cabot Corporation having the following nominal composition in weight percent:

15.5% chromium,
15% molybdenum,
4% tungsten,
5.5% iron,
0.8% carbon, and
balance, nickel.

It has been recognized that greater concentrations of molybdenum would result in improved corrosion resistance, however, greater concentrations of molybdenum in "Hastelloy C", for example, would make the alloy unworkable mechanically because of the presence of chromium. Thus, corrosion resistant alloys which include greater concentrations of molybdenum generally have little or no chromium. "Hastelloy B", for example, has the following nominal composition, in weight percent:

28 to 30% molybdenum,
5% iron,
0.05% carbon, and
balance, nickel.

"Hastelloy B", however, can only be used in closed systems because ferrous and cupric ions will be formed with chlorine in an open system. The addition of chromium would eliminate this problem, however, the alloy would be unworkable mechanically, as described above.

Other commercially available corrosion resistant alloys include a ferrous base Fe-Cr-Al-Y alloy containing 24% chromium, 8% aluminum, and 0.5% yttrium, a 50%-50% nickel, chromium alloy and "WCT 18997" alloy, available from Wear Control Technology, having the following nominal composition, in weight percent:

25% iron,
21% molybdenum,
5% tungsten,
4.5% titanium,
0.3% vanadium,
0.3% aluminum,
1.5% silicon.

The Fe-Cr-Al-Y alloy is used commercially in highly oxodizing environments. The 50% Ni-50% Cr alloy is used commercially as a coating alloy for many corrosive environments. The WCT 18997 alloy has also had widespread commercial acceptance for plasma spray corrosion resistance applications.

The commercially available corrosion resistant alloys are not, however, suitable for thermal spray coatings subjected to highly oxodizing or reducing corrosive atmospheres, such as boiling sulfuric and hydrochloric acid solutions, such as boiler tubes and paper and pulp digesters, including the heating tubes and parts in contact with the digesting liquor. The corrosion resistant thermal spray alloy and coating method of this invention is particularly suitable of such applications.

SUMMARY OF THE INVENTION

The coating alloy of this invention is specifically formulated for thermal spray coating, particularly plasma spray, and therefore does not have to be thermomechanically workable. Thermal spray, as used herein, includes plasma spray, combustion spray, electric arc, plasma transferred arc surfacing and similar coating processes. This approach permits the use of greater concentrations of molybdenum in combination with chromium in a nickel base alloy, which results in substantial improvement in the corrosion resistance of the resultant coating. Further, unexpectedly, the coating formed with the thermal spray alloy of this invention is extremely tenacious and dense, resulting in an improved coating capable of withstanding highly corrosive atmospheres, including boiling sulfuric and hydrochloric acid solutions.

The thermal spray metal alloy of this invention is preferably in the form of an alloy powder having a particle size suitable for plasma and flame spray application. The alloy powder is preferably formed by gas atomization in an inert atmosphere, limiting oxidation of the metal alloy powder. The alloy metal powder is then applied as a coating by thermal spraying the powdered alloy on parts which are subject to highly corrosive atmospheres.

As described, the thermal spray nickel base alloy powder of this invention has a high concentration of molybdenum, i.e. more than 20% by weight, and more than 12% by weight chromium. The alloy also preferably has more than 3% by weight iron, permitting the addition of molybdenum in the form of ferromolybdenum, which is less expensive than pure molybdenum. Copper and vanadium may be added to improve the pitting corrosion resistance of the coating. The nickel base alloy preferably includes 12 to 20% by weight chromium and 20 to 40% by weight molybdenum, wherein the iron concentration may be 0 to 10% by weight and the concentration of copper plus vanadium may be 0.3 to 2%, by weight. It will be understood that the alloy will include various impurities, up to about 5%, by weight.

The most preferred composition of the plasma spray alloy powder of this invention includes 25 to 35% molybdenum, 12 to 20% chromium, 0.5 to 3% copper plus vanadium, 3 to 10% iron, plus impurities up to about 5% and the balance in nickel, all in weight percent. The most preferred nominal composition of the spray alloy powder of this invention in weight percent is 30% molybdenum, 15% chronium, 1% copper plus vanadium, 5% iron, less than about 0.5% impurities and the balance nickel.

A plasma sprayed coating of the powdered alloy of this invention forms an extremely tenacious, dense corrosion resistant coating on metal surfaces which is able to withstand extended contact with boiling sulfuric and hydrochloric acid solutions. Other advantages and meritorious features of the corrosion resistant thermal spray alloy and coating method of this invention will be more fully understood from the following detailed description of the preferred embodiments and method of this invention.

PREFERRED EMBODIMENTS AND METHOD OF THIS INVENTION

As described above, the corrosion resistant alloy composition of this invention cannot be mechanically worked by conventional methods. The alloy powder is formed by atomization, preferably gas atomization in an inert atmosphere, as disclosed in U.S. Pat. No. 3,639,548, which is assigned to the assignee of the present application. The alloy composition is melted in a crucible, then introduced into a gas atomization nozzle which atomizes the molten metal alloy, which is then collected in an enclosed chamber. In the preferred method of this invention, the alloy powder is collected in a dry state in the atomization chamber which has been flooded with an inert gas. A suitable inert gas is argon, however, other inert gases may also be utilized.

The alloy metal powder must have a particle size range suitable for thermal spray applications, preferably plasma spray. A suitable size range for such applications is a metal powder screened to −140 mesh toten microns. A metal alloy powder of this size range produced in an inert atmosphere will be substantially free of an oxidation coating which may affect the formation of a dense tenacious coating when the powder is thermally sprayed on the part to be coated.

As described, the metal alloy thermal spray powder of this invention has the following general composition, in weight percent:

12 to 20% chromium,
20 to 40% molybdenum,
0.3 to 2% copper plus vanadium,
0 to 10% iron,
impurities, including carbon, up to about 5%, and balance, nickel.

The molybdenum may be added to the alloy as ferromolybdenum, which is substantially less expensive than pure molybdenum. Additions of iron up to about 10% do not affect the corrosion resistance of the resultant coating. Concentrations of iron greater than about 10% adversely affects the corrosion resistance of the alloy coating.

The commercial corrosion resistant alloys which include chromium generally have 15% by weight of less molybdenum. The nickel base metal alloy composition of this invention includes 20 to 40% by weight molybdenum, and more preferably about 30% by weight. Concentrations of molybdenum above about 35 to 40% by weight have little affect upon the corrosion resistance of the coating. The metal alloy composition further includes 12 to 20% by weight chromium. Concentrations of chromium less than about 12% generally impart inadequate corrosion resistance.

It is understood that the metal alloy composition of this invention is not thermomechanically workable, however, workability is not a prerequisite to the method of applying a corrosion resistant coating of this invention, which includes thermal spraying the coating on the parts to be coated. Commercial corrosion resistant alloys which include more than abouit 15% by weight molybdenum, such as "Hastelloy B", include litle or no chromium. Conversely, alloys which include substantial concentrations of chromium, include less molybdenum for workability.

The most preferred embodiment of this invention includes copper and/or vanadium which provides additional protection for the coated part, particularly pitting corrosion resistance. The preferred range of copper plus vanadium is 0.3 to 2% by weight. Additions of copper plus vanadium less than about 0.3% has little affect upon the corrosion resistance of the alloy and concentrations above about 2% in the alloy shows little additional improvement.

The remaining elements in the alloy metal composition are present primarily as impurities. In a metal alloy which must be mechanically worked, carbon concentrations below about 0.05% by weight adversely affects the weldability of the alloy. In view of the fact that the metal alloy composition of this invention is not welded or mechanically worked, the concentration of carbon is generally not a concern. Similarly, the metal alloy of this invention may include other additions or impurities, including for example manganese, phosphorus, sulfur and silicon. Impurities and additions up to about 5% by weight to the thermal spray metal alloy of this invention do not adversely affect the corrosion resistance of the alloy coating.

The more preferred thermal spray metal alloy composition of this invention comprises the following, in weight percent: 25 to 35% molybdenum, 12 to 20% chromium, 3 to 10% iron and the balance nickel. More preferably, as described above, the alloy also includes 0.5 to 3% copper plus vanadium, and impurities and additions up to about 5%. The range of chromium in the most preferred embodiment is 12 to 18%, by weight. The nominal and most preferred composition of the thermal spray metal alloy powder of this invention consists essentially of the following, in weight percent: 15% chromium, 30% molybdenum, 1% copper plus vanadium, 5% iron, impurities plus additions up to about 1%, and the balance nickel.

The method of applying a corrision resistant alloy coating of this invention includes applying the coating by thermal spraying the preferred composition of the heated metal alloy powder on the surface of the metal part to be coated. As described, the thermal spray metal alloy powder is preferably formed by gas atomization and the particle size range of the metal alloy powder must be suitable for thermal spraying, preferably plasma spray. As an example of the thermal spray metal alloy powder of this invention, an alloy powder of the following composition was formed by gas atomization in an enclosed argon chamber:

14.4% chromium,
30.14% molybdenum,
4.69% iron,
0.59% vanadium,
0.39% copper, and
balance nickel.

All percentages are given in weight percent. The alloy metal composition was also found to include 0.039% carbon, less than 0.1% mangenese, less than 0.005% phospherus, about 0.005% sulfur, and 0.12% silicon in weight percent, as impurities.

The above described composition of alloy powder produced by inert gas atomization was then screened to −140 +325 mesh. Coatings were then formed on ferrous metal parts by a conventional plasma spray apparatus, wherein the alloy powder is ionized in a plasma and projected onto the part to be coated. The resulting coatings had a thickness of 0.020 inches and were found to be very dense, about 99% dense, and extremely tenacious.

The coated parts were then tested and compared with parts coated by plasma spray with the above described commercial corrosion resistant alloys, including "Hastelloy C", the Fe-Cr-Al-Y composition, the 50% Ni-50% Cr composition, and "WCT 18997", which were obtained from Cabot Corporation and Wear Control Technology. The coated parts were tested by immersion in boiling sulfuric and hydrochloric acid solutions, having a concentration of 5% and 10%, respectively.

All of the commercial corrosion resistant alloys failed in the boiling sulfuric acid solutions after fsixty (60) hours. All of the commercial corrosion resistant coatings, except the "WCT 18997" alloy, failed in the boiling hydrochloric acid solution in less than ten (10) hours. The parts coated with the commercial corrosion resistant alloys were cracked, indicating that the acid penetrated the coating to the substrate and several of the coatings peeled in certain areas.

The parts coated with the thermal spray alloy composition of this invention did not fail in either test after 120 hours of immersion in the boiling acid solutions. The coatings were essentially free of pitting or cracking, and no peeling occurred, indicating that the coatings were extremely tenacious.

The corrosion resistant thermal spray alloy of this invention may be used to coat any metal surface which will accept plasma coatings, ilow carbon steels utilized, for example, in boiler tubes and paper and pulp digesters, including heating tubes and the parts in contact with the digesting liquor. The thermal spray alloy and coating method of this invention therefore provides an important improvement over the prior art. As described, the resultant coating is able to withstand highly corrosive atmospheres and the coating is extremely dense and tenacious. It will be understood by those skilled in the art that the composition of the thermal spray powder of this invention may however be modified within the purview of the appended claims, which follow.

I claim:

1. A method of applying a corrosion resistant, extremely tenacious dense coating on metal parts subject to an acidic corrosive environment, said coating applied by thermal spraying a heated nickel base metal alloy powder on the surface of the metal part to be coated, said nickel base alloy powder having 20 to 40 percent by weight molybdenum, 12 to 20 percent by weight chromium, 0 to 10 percent by weight iron and 0.3 to 3 percent by weight copper plus vanadium.

2. The method of applying a corrosion resistant alloy on metal parts, as defined in claim 1, wherein said metal alloy powder is produced by melting the alloy, then atomizing the molten metal alloy, forming an alloy metal powder having a particle size range suitable for thermal spraying.

3. A method of forming a corrosion resistant extremely tenacious dense coating on a metal part which is to be exposed to a corrosive atmosphere, comprising: plasma spraying a powdered nickel base metal alloy on the metal part to be coated, said powdered metal alloy consisting essentially of 12 to 20% by weight chromium, 20 to 40% by weight molybdenum, 0 to 10% by weight iron, 0.3 to 3% by weight copper plus vanadium, additions and impurities up to 5% by weight, and the balance nickel.

4. The method of forming a corrosion resistant coating on a metal part as defined in claim 3, wherein said powdered nickel base metal alloy is produced by melting the alloy, then atomizing the molten metal alloy to form an alloy metal powder having a particle size range suitable for plasma spraying and wherein said metal alloy has 3 to 10% by weight iron.

* * * * *